US010316453B2

(12) United States Patent
Yu et al.

(10) Patent No.: US 10,316,453 B2
(45) Date of Patent: Jun. 11, 2019

(54) TOP-LOADING TYPE WASHING MACHINE

(71) Applicant: LG ELECTRONICS INC., Seoul (KR)

(72) Inventors: Insik Yu, Seoul (KR); Youngjong Kim, Seoul (KR); Kyubum Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 49 days.

(21) Appl. No.: 15/281,764

(22) Filed: Sep. 30, 2016

(65) Prior Publication Data

US 2017/0096765 A1 Apr. 6, 2017

(30) Foreign Application Priority Data

Oct. 2, 2015 (KR) ..... 10-2015-0139270
Oct. 2, 2015 (KR) ..... 10-2015-0139271

(51) Int. Cl.
*D06F 37/40* (2006.01)
*D06F 37/12* (2006.01)
(Continued)

(52) U.S. Cl.
CPC ..... *D06F 37/40* (2013.01); *D06F 37/12* (2013.01); *D06F 37/203* (2013.01);
(Continued)

(58) Field of Classification Search
None
See application file for complete search history.

(56) References Cited

U.S. PATENT DOCUMENTS 5,661,990 A 9/1997 Chong
2004/0118167 A1* 6/2004 Kim ..... B08B 3/12 68/3 R
(Continued)

FOREIGN PATENT DOCUMENTS

CN 101446017 A 6/2009
JP 5079667 B2 11/2012
(Continued)

OTHER PUBLICATIONS

Daewoo Electronics, KR1020050037189 KPA Abstract translation, 1998 (Year: 1998).*
(Continued)

*Primary Examiner* — Jason Y Ko
*Assistant Examiner* — Cristi J Tate-Sims
(74) *Attorney, Agent, or Firm* — Dentons US LLP

(57) ABSTRACT

A top-loading-type washing machine including a drum, a drive module for rotating the drum via a drive shaft, inner and outer pulsators placed in the drum so as to be rotated in opposite directions, and a gearbox connected to the drive shaft for rotating both the pulsators. The gearbox includes a sun gear rotatably connected to the drive shaft, planetary gears rotatably engaged with the sun gear, a ring gear rotatably engaged with the planetary gears, a carrier for connecting the planetary gears so as to be rotated along with the planetary gears, a gear housing to which the ring gear is fixed, the gear housing being coupled to the outer pulsator, and a carrier shaft coupled to the inner pulsator. The top-loading-type washing machine further includes a long-axis bolt fastened to the drive shaft and rotatably inserted into a carrier shaft bore of the carrier shaft.

20 Claims, 8 Drawing Sheets

(51) Int. Cl.

| | |
|---|---|
| ***D06F 37/20*** | (2006.01) |
| ***D06F 39/00*** | (2006.01) |
| ***D06F 39/08*** | (2006.01) |
| *D06F 17/08* | (2006.01) |
| *D06F 17/10* | (2006.01) |
| *D06F 23/04* | (2006.01) |

(52) U.S. Cl.
CPC ..... *D06F 39/005* (2013.01); *D06F 39/083* (2013.01); *D06F 39/088* (2013.01); *D06F 17/08* (2013.01); *D06F 17/10* (2013.01); *D06F 23/04* (2013.01)

(56) References Cited

U.S. PATENT DOCUMENTS

| | | | | |
|---|---|---|---|---|
| 2005/0081573 | A1* | 4/2005 | Han | D06F 37/304 68/12.02 |
| 2014/0109627 | A1* | 4/2014 | Lee | D06F 17/08 68/133 |

FOREIGN PATENT DOCUMENTS

| | | | |
|---|---|---|---|
| KR | 1019960015481 | A | 11/1996 |
| KR | 1019970006592 | A | 2/1997 |
| KR | 2019980046029 | U | 9/1998 |
| KR | 200314462 | Y1 | 5/2003 |
| KR | 1020030042621 | A | 6/2003 |
| KR | 200327068 | Y1 | 9/2003 |
| KR | 1020050037189 | A | 4/2005 |
| KR | 1020140051664 | A | 5/2014 |

OTHER PUBLICATIONS

LG Electronics, KR102005037189 KPA Abstract translation, 2005 (Year: 2005).*

* cited by examiner

TOP-LOADING TYPE WASHING MACHINE

CROSS-REFERENCE TO RELATED APPLICATION

This application claims the priority benefit of Korean Patent Application No. 10-2015-0139270, filed on Oct. 2, 2015 and Korean Patent Application No. 10-2015-0139271 filed on Oct. 2, 2015 in the Korean Intellectual Property Office, the disclosure of each is incorporated herein by reference.

BACKGROUND

1. Field

The present disclosure relates to a top-loading-type washing machine having pulsators.

2. Description of the Related Art

Generally, a washing machine is an apparatus that washes laundry using, for example, de-emulsification of detergent, a water stream generated by rotation of a wash tub or a wash blade, and shocks applied by the wash blade, and performs washing, rinsing, or dehydration to remove contaminants adhered to laundry (hereinafter also referred to as "fabric") using the action of detergent and water.

A conventional top-loading-type washing machine includes a pulsator placed inside a drum.

The pulsator may be rotated independently of the drum. A conventional pulsator may be rotated along with the drum, or may be rotated in the opposite direction as the drum.

When the drum and the pulsator are rotated in opposite directions, power consumption is high, but the washing force that is exhibited is not commensurate with the amount of power that is consumed.

SUMMARY

It is one object of the present disclosure to provide a top-loading-type washing machine in which two pulsators are installed.

It is another object of the present disclosure to provide a top-loading-type washing machine in which an inner pulsator and an outer pulsator are installed.

It is another object of the present disclosure to provide a top-loading-type washing machine in which an inner pulsator and an outer pulsator may be rotated in opposite directions.

It is another object of the present disclosure to provide a top-loading-type washing machine which exhibits low power consumption during the operation of an inner pulsator and an outer pulsator.

It is another object of the present disclosure to provide a top-loading-type washing machine in which the rotation speeds of an inner pulsator and an outer pulsator are variable depending on the size of the laundry load.

It is another object of the present disclosure to provide a fastening structure capable of coupling an inner pulsator to a drive shaft.

It is another object of the present disclosure to provide a fastening structure for coupling an inner pulsator to a drive shaft so that the inner pulsator is rotated relative to the drive shaft, rather than being rotated along with the drive shaft.

It is another object of the present disclosure to provide a fastening structure having a long-axis bolt that penetrates an inner pulsator and is fastened to a drive shaft.

It is a further object of the present disclosure to provide a fastening structure which is rotatably fastened to a drive shaft and is rotated relative to an inner pulsator so as to minimize friction with the rotating inner pulsator.

In accordance with an aspect of the present disclosure, the above and other objects can be accomplished by the provision of a top-loading-type washing machine including a drum in which vertically introduced laundry is loaded, a drive module for rotating the drum via a drive shaft, an inner pulsator located on the drive shaft, the inner pulsator being rotated by torque from the drive module, an outer pulsator placed in the drum, the outer pulsator located below the inner pulsator, the outer pulsator being rotated in a direction opposite to that of the inner pulsator by torque from the drive module, and a gearbox connected to the drive shaft so as to receive torque from the drive module, the gearbox rotating the inner pulsator and the outer pulsator in opposite directions.

The gearbox includes a sun gear connected to and rotating with the drive shaft, a plurality of planetary gears engaged with the sun gear, each of the planetary gears rotating on its own rotation axis while traveling along an outer circumferential surface of the sun gear, a ring gear engaged with the planetary gears so as to perform rotation, a carrier for providing the rotation axis of each planetary gear and for connecting the planetary gears to one another, the carrier being rotated along with the planetary gears when the planetary gears travel along the outer circumferential surface of the sun gear, a gear housing to which the ring gear is fixed, the gear housing being coupled to the outer pulsator for transferring torque, and a carrier shaft formed on the carrier and coupled to the inner pulsator for transferring torque. The carrier shaft has a carrier shaft bore formed therein so as to communicate with an inside of the gearbox. The top-loading-type washing machine further includes a long-axis bolt. The long-axis bolt is fastened at a lower end thereof to the drive shaft, and is inserted into the carrier shaft bore so as to be rotated in the carrier shaft bore.

The top-loading-type washing machine according to a first embodiment may further include a top bolt for connecting the inner pulsator and the carrier shaft to each other. The long-axis bolt according to the first embodiment may have an upper end inserted into the carrier shaft bore.

The long-axis bolt according to a second embodiment may penetrate the carrier shaft, may have an upper end supported by the inner pulsator, and may be rotated relative to the inner pulsator and the carrier shaft.

BRIEF DESCRIPTION OF THE DRAWINGS

The above and other objects, features and other advantages of the present invention will be more clearly understood from the following detailed description taken in conjunction with the accompanying drawings, in which:

The following description will be based on the embodiments of the present invention, i.e. the first embodiment and the second embodiment. FIGS. 1, 3 to 6, and 8 are views illustrating common elements of the first embodiment and the second embodiment, FIGS. 2A and 7A are views illustrating the configuration of the first embodiment, and FIGS. 2B and 7B are views illustrating the configuration of the second embodiment. The elements common to both the first embodiment and the second embodiment are designated by the same reference numerals.

DETAILED DESCRIPTION

Figure 1:
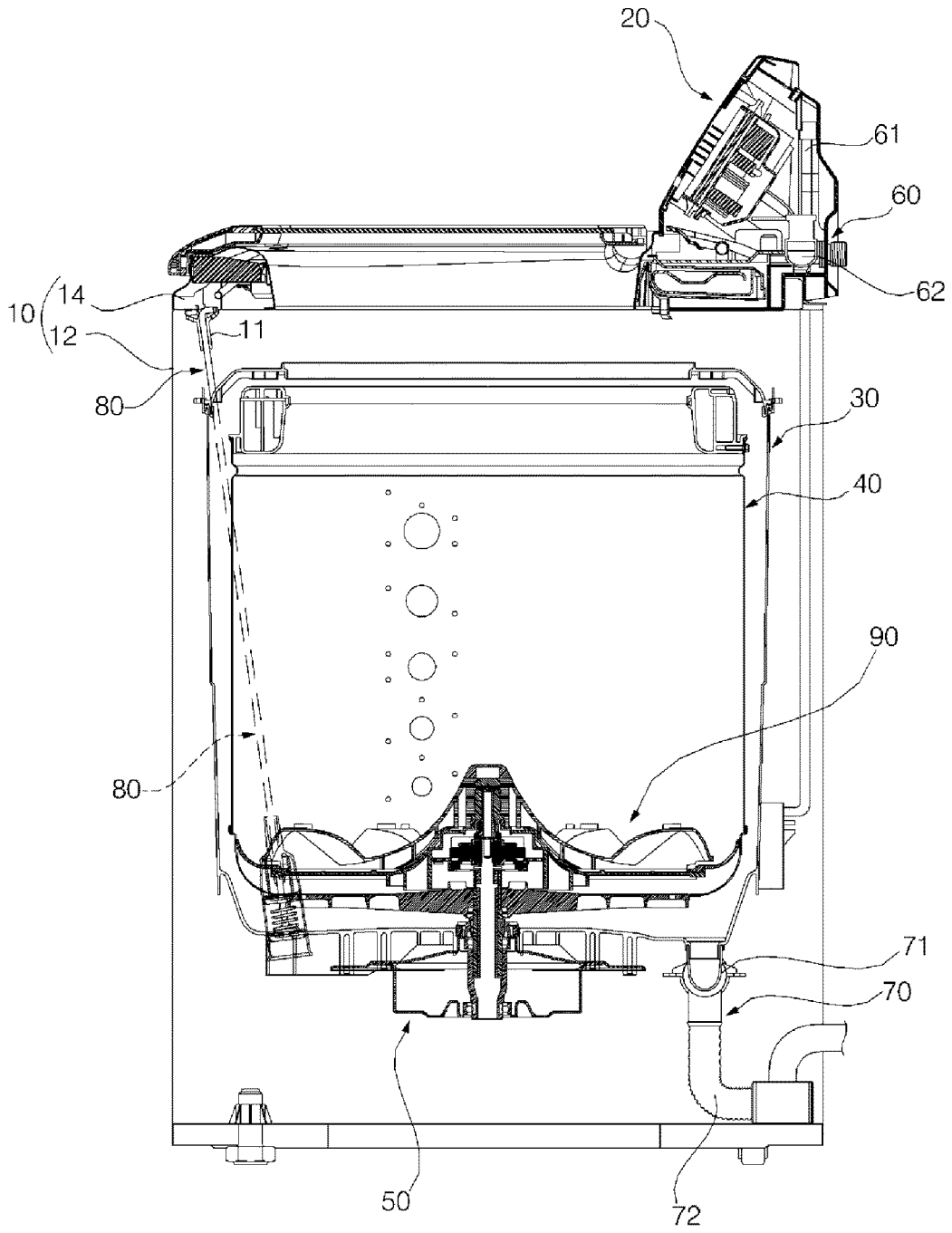
FIG. 1 is a sectional view illustrating the interior of a washing machine according to an embodiment of the present invention.

Referring to FIG. 1, a washing machine according to the present embodiment (i.e., the first embodiment or the second embodiment) includes a casing 10 defining the external appearance of the washing machine, and a control module 20 installed on casing 10.

Control module 20 includes, for example, manipulation keys for receiving manipulation force from a user, and a display for displaying information related to the state of operation of the washing machine.

The washing machine includes a tub 30 placed inside casing 10 for storing wash water therein, a drum 40 placed inside tub 30 for storing laundry to be washed, a drive module 50 placed on tub 30 for rotating drum 40 in order to wash the laundry, a water supply module 60 for supplying wash water to tub 30, a water drain module 70 for discharging wash water stored in tub 30, a suspension module 80 for reducing or absorbing vibrations generated in tub 30, and a dual pulsator 90 placed in drum 40 so as to be rotated upon receiving drive power from drive module 50.

Dual pulsator 90 is comprised of an inner pulsator 92 and an outer pulsator 94. The axis centers of the respective pulsators 92 and 94 are located on the imaginary axis of a drive shaft of drive module 50. The respective pulsators 92 and 94 are adapted to be rotated in opposite directions.

Casing 10 includes a main body 12 in which tub 30 and drum 40 are placed, a top cover 14 located on the top side of main body 12, and a door formed in top cover 14 for opening or closing the inside of casing 10.

Control module 20 includes, for example, manipulation buttons and a dial for receiving manipulation force from a user.

Control module 20 is provided with a display unit (not illustrated) for showing various pieces of information about the washing machine to the user. In the present embodiment, the display unit is located in top cover 14.

Tub 30 is connected to water supply module 60 and stores wash water supplied from water supply module 60.

Tub 30 may be connected to water drain module 70, and water drain module 70 may discharge the wash water stored in tub 30 outward.

Drum 40 is placed inside tub 30. Drum 40 is rotated upon receiving drive power from drive module 50.

Drum 40 includes a drum body having a cylindrical shape, and a drum base coupled to the bottom side of the drum body.

A hub 46 is disposed on the drum base. Drive module 50 may selectively transfer drive power to hub 46.

Drum 40 is configured to be rotated forward or in reverse relative to tub 30.

In the present embodiment, water supply module 60 includes a water supply valve 61 and a water supply path 62, which are located on top cover 14.

In the present embodiment, water drain module 70 includes a water drain valve 71 connected to tub 30, and a water drain path 72 connected to water drain valve 71.

Suspension module 80 is connected to tub 30, and reduces vibrations generated in tub 30 using at least one of elasticity or absorption.

In the present embodiment, suspension module 80 is located between casing 10 and tub 30. Suspension module 80 supports the bottom of tub 30 and hangs from top cover 14.

The structure of dual pulsator 90 according to the present embodiment (i.e. the first embodiment or the second embodiment) will be described with reference to FIGS. 2A to 8.

In the present embodiment, drive module 50 includes a motor 52 located on the bottom side of tub 30, a drive shaft penetrating tub 30 and connected to drum 40, and a gearbox 100 for transferring drive power of drive shaft 54 to dual pulsator 90.

Drive shaft 54 is disposed to penetrate hub 46.

Drive shaft 54 may be selectively connected to hub 46 of drum 40. Thus, only drum 40 may be rotated by drive module 50.

Drive shaft 54 may be selectively connected to gearbox 100.

When drive shaft 54 and gearbox 100 are connected to each other, dual pulsator 90 may be rotated.

Dual pulsator 90 is located at the upper side of hub 46.

Dual pulsator 90 includes inner pulsator 92 and outer pulsator 94. Inner pulsator 92 is located at the inner side of outer pulsator 94.

Inner pulsator 92 has a circular shape when viewed in a plan view.

Outer pulsator 94 has a ring shape when viewed in a plan view.

An installation hole 95 in which inner pulsator 92 is rotated is defined inside outer pulsator 94.

Inner pulsator 92 and outer pulsator 94 may be rotated in different directions from each other.

In the present embodiment, dual pulsator 90 further includes a pulsator base 96 located at the lower side of inner pulsator 92. Pulsator base 96 and outer pulsator 94 are defined as an outer assembly.

Inner pulsator 92 is located above outer pulsator 94. Inner pulsator 92 is rotated above outer pulsator 94.

Inner pulsator 92 may be provided with an upwardly protruding wash blade 91. In the present embodiment, three wash blades 91 are arranged at an angular interval of 120 degrees when viewed in a plan view.

Outer pulsator 94 may also be provided with an upwardly protruding wash blade 93. In the present embodiment, six wash blades 93 are equidistantly arranged when viewed in a plan view.

Inner pulsator 92 is located on the center of outer pulsator 94 when viewed in a plan view. Rotation centers of inner pulsator 92 and outer pulsator 94 are located on drive shaft 54.

Installation hole 95 is defined inside outer pulsator 94. An installation groove 97 is formed in the inner edge of outer pulsator 94 defining installation hole 95. A portion of inner pulsator 92 is inserted into installation groove 97.

Pulsator base 96 is located below installation hole 95. Pulsator base 96 covers installation hole 95. Pulsator base 96 is fixed to outer pulsator 94.

Gearbox 100 of drive module 50 is located below pulsator base 96. Gearbox 100 located between pulsator base 96 and hub 46. Gearbox 100 penetrates pulsator base 96 and is connected to inner pulsator 92.

Gearbox 100 is connected to motor 52 of drive module 50 and receives drive power. Drive shaft 54 of drive module 50 is also connected to gearbox 100.

Gearbox 100 is connected to each of inner pulsator 92 and outer pulsator 94. Gearbox 100 may be selectively connected to motor 52.

Gearbox 100 may receive drive power of motor 52 and transfer the drive power to inner pulsator 92 and outer pulsator 94.

Gearbox 100 rotates inner pulsator 92 and outer pulsator 94 in opposite directions. Gearbox 100 may rotate inner pulsator 92 and outer pulsator 94 at different speeds.

Gearbox 100 may rotate inner pulsator 92 and outer pulsator 94 at different speeds depending on the size of the laundry load even if constant drive power is input from motor 52.

Gearbox 100 includes a sun gear 110 rotatably connected to drive shaft 54 of motor 52, a plurality of planetary gears 120 rotatably engaged with sun gear 110, a ring gear 130 rotatably engaged with planetary gears 120, a carrier 140 for connecting planetary gears 120 to one another, and a gear housing 150 to which ring gear 130 is fixed, sun gear 110, planetary gears 120 and carrier 140 being placed inside gear housing 150.

Sun gear 110, planetary gears 120, ring gear 130, and carrier 140 are defined as a planetary gear assembly. The constituent elements of the planetary gear assembly are engaged with or coupled to each other, and therefore may be systematically operated when sun gear 110 is rotated.

In the present embodiment, carrier 140 is operated in a non-constrained free state.

Sun gear 110 is coupled to drive shaft 54. Sun gear 110 is provided on inner and outer sides thereof with gear teeth.

Sun gear 110 has a sun gear bore 111 vertically formed therein. The inner circumferential surface of sun gear 110 defining sun gear bore 111 is provided with inner teeth 112. Outer teeth 114 are formed on the outer circumferential surface of sun gear 110.

Drive shaft 54 is inserted into sun gear bore 111. Drive shaft 54 is engaged with inner teeth 112. Drive shaft 54 has a serrated shape.

Planetary gears 120 are arranged around sun gear 110.

Planetary gears 120 may rotate on their axes while rotating along the circumference of sun gear 110. To rotate on its axis, each planetary gear 120 has a planetary gear bore 121 vertically formed therein.

Planetary gear 120 may rotate about planetary gear bore 121. In addition, planetary gear 120 may rotate along outer teeth 114 of sun gear 110.

In the present embodiment, six planetary gears 120 are arranged. Each planetary gear 120 is engaged with outer teeth 114 of sun gear 110. Sun gear 110 and planetary gears 120 are horizontally arranged.

Ring gear 130 is located at the outer side of planetary gears 120.

In the present embodiment, ring gear 130 is fixed inside gear housing 150.

Ring gear 130 has a ring shape. Ring gear 130 has teeth formed on the inner circumferential surface thereof. Ring gear 130 is engaged with all of planetary gears 120 at the same time.

Planetary gears 120 are located between ring gear 130 and sun gear 110, and are simultaneously engaged with ring gear 130 and sun gear 110.

Carrier 140 connects planetary gears 120 to one another. Planetary gears 120 may be rotated at the same speed by carrier 140.

Carrier 140 includes a lower carrier body 142, an upper carrier body 144, and a carrier shaft 160 formed on upper carrier body 144 so as to penetrate gear housing 150 and be coupled to inner pulsator 92.

Sun gear 110 and planetary gears 120 are located between upper carrier body 144 and lower carrier body 142.

Lower carrier body 142 is located below planetary gears 120.

Upper carrier body 144 is located above planetary gears 120.

In the present embodiment, a planetary gear shaft 141 is formed on lower carrier body 142. Planetary gear shaft 141 is inserted into planetary gear bore 121. Planetary gear 120 rotates about planetary gear shaft 141.

A plurality of planetary gear shafts 141 are arranged on lower carrier body 142 in a circumferential direction. Planetary gear shafts 141 are equidistantly arranged in the circumferential direction.

Sun gear 110 is also located above lower carrier body 142. Sun gear 110 is rotated above lower carrier body 142.

Lower carrier body 142 is provided with a lower sun gear recess 146, into which sun gear 110 is inserted. Drive shaft 54 is also inserted through lower sun gear recess 146. Drive shaft 54, inserted through lower sun gear recess 146, is coupled to sun gear 110.

Upper carrier body 144 is located above lower carrier body 142. Sun gear 110 supports upper carrier body 144. Upper carrier body 144 and lower carrier body 142 are coupled to each other.

Upper carrier body 144 has an upper sun gear recess 147 formed in the lower surface thereof, into which a portion of sun gear 110 is inserted. Upper carrier body 144 further has a planetary gear shaft recess 148 formed in the lower surface thereof, into which planetary gear shaft 141 is inserted.

Upper carrier body 144 and lower carrier body 142 are assembled with each other and operate integrally with each other.

Carrier shaft 160 protrudes upward from upper carrier body 144. Inner pulsator 92 is rotatably connected to carrier shaft 160.

Carrier shaft 160 has a carrier shaft bore 161 formed therein. Carrier shaft bore 161 is formed in the center of carrier shaft 160.

Carrier shaft 160 penetrates gear housing 150 and protrudes upward from gear housing 150.

Although two separate carrier bodies are fabricated in the present embodiment, a single carrier body may be fabricated. When the single carrier body is fabricated, all of planetary gear shafts 141 and carrier shaft 160 are formed on the single carrier body.

Gear housing 150 is comprised of a lower housing 152 and an upper housing 154.

Ring gear 130 may be fixed to one of lower housing 152 and upper housing 154.

In the present embodiment, ring gear 130 is fixed to the inner surface of upper housing 154. Upper housing 154 has a carrier shaft hole 151, through which carrier shaft 160 penetrates.

When torque is transferred to ring gear 130, gear housing 150 is rotated along with ring gear 130.

In the present embodiment, gear housing 150 is connected to outer pulsator 94. Gear housing 150 rotates outer pulsator 94.

In order to transfer torque of gear housing 150 to outer pulsator 94, upper housing 154 is provided with a housing holding protrusion 155.

Outer pulsator 94 is coupled to housing holding protrusion 155. Housing holding protrusion 155 may interfere with outer pulsator 94 and may transfer torque to outer pulsator 94 via interference therebetween.

In the present embodiment, housing holding protrusion 155 is configured to vertically protrude. Outer pulsator 94 is vertically coupled to housing holding protrusion 155 and is horizontally caught by housing holding protrusion 155.

Outer pulsator 94 and housing holding protrusion 155 may be formed in various directions and shapes.

In addition, outer pulsator 94 and gear housing 150 may be coupled to each other via any of various methods. For example, outer pulsator 94 and gear housing 150 may be hook-coupled to each other. Outer pulsator 94 and gear housing 150 may be fastened and coupled to each other.

For rotation of sun gear 110, planetary gears 120, carrier 140 and gear housing 150, in the present embodiment, bearings are arranged.

A first bearing 171 may be located between sun gear 110 and lower carrier body 142. First bearing 171 may be located in lower sun gear recess 146.

A second bearing 172 may be located between sun gear 110 and upper carrier body 144. Second bearing 172 may be located in upper sun gear recess 147. First bearing 171 and second bearing 172 minimize friction to enable the efficient rotation of sun gear 110.

A third bearing 173 may be located between lower carrier body 142 and lower housing 152. Third bearing 173 minimizes friction to enable the efficient rotation of lower carrier body 142 and gear housing 150.

A fourth bearing 174 may be located between upper carrier body 144 and upper housing 154. Fourth bearing 174 may be located between carrier shaft 160 and upper housing 154. Fourth bearing 174 is inserted into and installed in upper housing 154. Upper housing 154 is provided with a bearing recess 153, into which fourth bearing 174 is inserted. In the present embodiment, bearing recess 153 and carrier shaft hole 151 are connected to each other. The diameter of bearing recess 153 is greater than the diameter of carrier shaft hole 151. Fourth bearing 174 minimizes friction to enable the efficient rotation of upper carrier body 144 or carrier shaft 160.

In the present embodiment, first bearing 171 is placed on carrier 140. First bearing 171 is placed on lower carrier body 142.

Second bearing 172 is installed to downwardly apply pressure to sun gear 110.

Lower carrier body 142 and upper carrier body 144 apply pressure to sun gear 110 through first bearing 171 and second bearing 172.

Sun gear 110 is fitted and installed between lower carrier body 142 and upper carrier body 144 and is rotatable only in the horizontal direction.

In the present embodiment, third bearing 173 is placed on lower housing 152. In addition, carrier 140 is placed on third bearing 173.

Fourth bearing 174 is fitted and installed between upper housing 154 and upper carrier body 144.

When upper housing 154 and lower housing 152 are assembled with each other, fourth bearing 174 and third bearing 173 support gear housing 150.

drive shaft 54 supports sun gear 110. Sun gear 110 supports planetary gears 120 and carrier 140. Carrier 140 supports gear housing 150. Carrier 140 supports inner pulsator 92. Gear housing 150 supports outer pulsator 94

Hereinafter, the operating process of the dual pulsator according to the present embodiment (i.e. the first embodiment or the second embodiment) will be described in more detail with reference to the accompanying drawings.

First, when power is applied to drive module 50 and motor 52 is operated, drive shaft 54 is rotated. When drive shaft 54 is rotated, sun gear 110 connected to drive shaft 54 is rotated.

Drive shaft 54 may be rotated clockwise or counterclockwise via operation of motor 52.

For convenience of description, the direction in which drive shaft 54 is rotated is defined as a forward direction, and the rotation direction opposite to the forward direction is defined as a reverse direction.

Sun gear 110, which is directly installed to drive shaft 54, is rotated in the forward direction.

Because planetary gears 120 come into contact with the outer circumference of sun gear 110 and are engaged with sun gear 110, planetary gears 120 are rotated in the direction opposite to the rotation direction of sun gear 110. That is, planetary gears 120 are rotated in the reverse direction.

Here, carrier 140, which connects planetary gears 120 to one another, is rotated in the forward direction opposite to the rotation direction of planetary gears 120. That is, sun gear 110 and carrier 140 are rotated in the same direction.

Each planetary gear 120 rotates about planetary gear shaft 141 and rotates along the outer circumference of sun gear 110. Planetary gear 120 is not fixed, but is free, thus receiving repulsive force when engaged with ring gear 130.

Thus, ring gear 130 is rotated in the reverse direction opposite to the rotation direction of carrier 140.

In this way, carrier 140 and ring gear 130 according to the present embodiment are rotated in opposite directions.

In the present embodiment, carrier 140 is coupled to inner pulsator 92 via carrier shaft 160, and gear housing 150 is coupled to outer pulsator 94.

As such, when sun gear 110 is rotated, inner pulsator and outer pulsator 94 may be rotated in opposite directions.

The present embodiment has a feature by which carrier 140 is in a free state rather than being constrained. Because carrier 140 is in the free state, the rotation speed of carrier 140 may vary depending on the load applied to inner pulsator 92 or outer pulsator 94.

In the present embodiment, torque is input to only sun gear 110, and all of planetary gears 120, carrier 140 and ring gear 130 are in the free state.

Thus, the rotation speed of inner pulsator 92 or the rotation speed of outer pulsator 94 may vary depending on the load applied to inner pulsator 92 or outer pulsator 94.

For example, the inner and outer pulsators 92 and 94 may be rotated at different speeds depending on whether a large load of laundry is located on inner pulsator 92 or outer pulsator 94. In addition, the rotation speeds of the inner and outer pulsators 92 and 94 may vary depending on the load even when laundry is located on both inner pulsator 92 and outer pulsator 94.

When inner pulsator 92 and outer pulsator 94 are rotated in opposite directions and the rotation speeds thereof vary as described above, the washing effect may be maximized. For example, an operation of twisting, rubbing, or squeezing laundry may be realized. In particular, because the speeds vary depending on the size of the laundry load, damage to the laundry may be reduced.

When the pulsator is operated at a high speed in the case of a large load of laundry as in the related art, the laundry may be damaged due to excess friction. In the washing machine according to the present embodiment, inner pulsator 92 or outer pulsator 94 may be rotated at a low speed under the condition of a high load, and may be rotated at a high speed under the condition of a low load.

Figure 6:
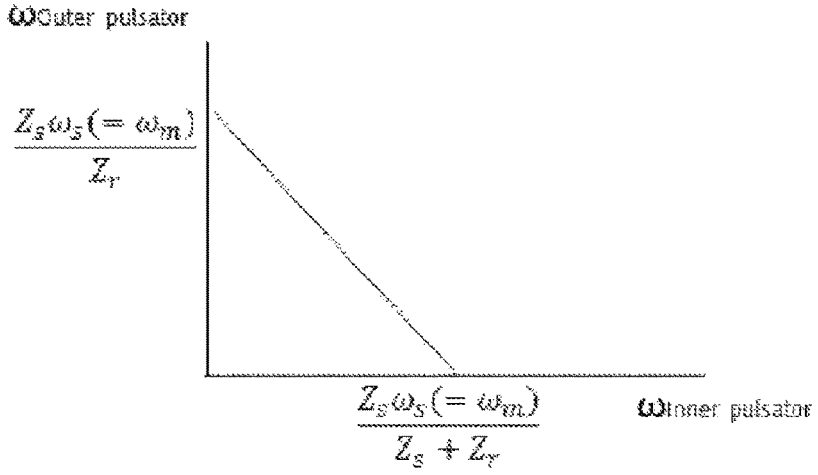
FIG. 6 is a graph illustrating the speed of a planetary gear assembly according to an embodiment of the present invention.

The rotation speeds of inner pulsator 92 and outer pulsator 94 are described by the graph of FIG. 6.

The rotation speed of the inner pulsator $W_{inner\ pulsator}$ is represented by the following Equation:

$$W_{Inner\ pulsator} = \frac{w_s Z_s - w_{Outer\ pulsator} Z_r}{Z_s + Z_r}$$

where, $W_s$: the rotation speed of the sun gear $W_m$: the rotation speed of the motor $W_r$: the rotation speed of the ring gear $W_{outer\ pulsator}$: the rotation speed of the outer pulsator $Z_s$: the number of teeth of the sun gear $Z_r$: the number of teeth of the ring gear In the present embodiment, because sun gear 110 and drive shaft 54 are directly connected to each other, the rotation speed of motor 52 and the rotation speed of sun gear 100 are the same.

In the present embodiment, because gear housing 150 to which ring gear 130 is fixed and outer pulsator 94 are directly connected to each other, the rotation speed of ring gear 130 and rotation speed of outer pulsator 94 are the same.

In the present embodiment, the number of teeth of sun gear 110 is 110, the number of teeth of planetary gear 120 is 20, and the number of teeth of ring gear 130 is 80.

Analyzing the graph based on the above equation, the rotation speed of the inner pulsator $W_{inner\ pulsator}$ is within the range from 0 to ⅓ $W_m$ (the rotation speed of the motor), and the rotation speed of the outer pulsator $W_{outer\ pulsator}$ is within the range from 0 to ½ $W_m$ (the rotation speed of the motor).

In the present embodiment (i.e. the first embodiment or the second embodiment), the top-loading-type washing machine includes drum 40 in which vertically introduced laundry is loaded, drive module 50 for rotating drum 40 via drive shaft 54, inner pulsator 92 placed in drum 40 and located on drive shaft 54 so as to be rotated upon receiving torque from drive module 50, outer pulsator 94 placed in drum 40 so as to be rotated in the direction opposite to the rotation direction of inner pulsator 92 upon receiving torque from drive module 50, and gearbox 100 located between drive module 50 and drum 40 and connected to drive shaft 54 so as to receive torque, gearbox 100 causing inner pulsator and outer pulsator 94 to be rotated in opposite directions.

Gearbox 100 includes sun gear 110 rotatably connected to drive shaft 54, planetary gears 120 engaged with sun gear 110 and configured to rotate on their axes while rotating along the outer circumferential surface of sun gear 110, ring gear 130 rotatably engaged with planetary gears 120, carrier 140 for providing the rotation axis of each planetary gear 120 and connecting planetary gears 120 to one another, carrier 140 being rotated when planetary gears 120 are rotated along the outer circumferential surface of sun gear 110, gear housing 150, to which ring gear 130 is fixed, gear housing 150 being coupled to outer pulsator 140 to transfer torque, and carrier shaft 160 formed on carrier 140 and coupled to inner pulsator 92 so as to transfer torque.

Carrier shaft bore 161 is formed in carrier shaft 160 so as to communicate with the inside of gear box 100. The top-loading-type washing machine further includes long-axis bolts 220 and 200. Each of the long-axis bolts 220 and 200 is fastened at the lower end thereof to drive shaft 54 and is inserted into carrier shaft bore 161 so as to be rotated in carrier shaft bore 161.

Figure 2A:
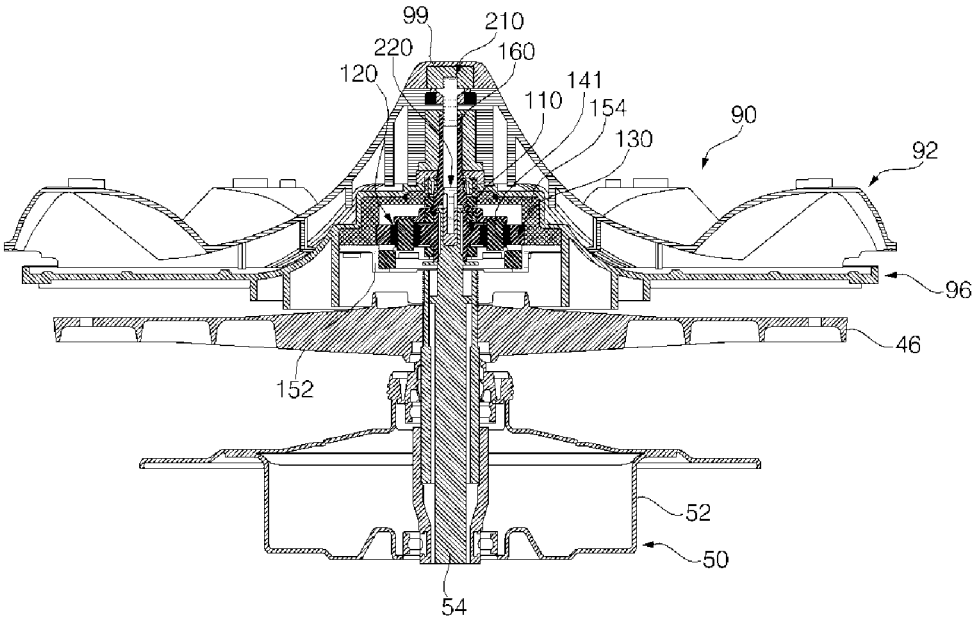
FIG. 2A is a sectional view illustrating a first embodiment of a dual pulsator illustrated in FIG. 1.
Figure 2B:
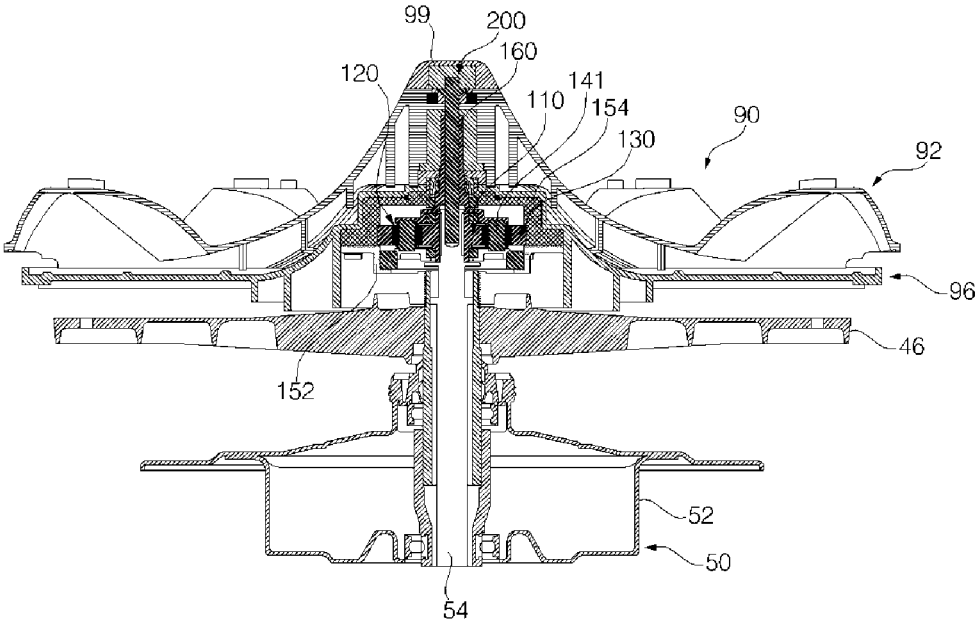
FIG. 2B is a sectional view illustrating a second embodiment of the dual pulsator illustrated in FIG. 1.
Figure 3:
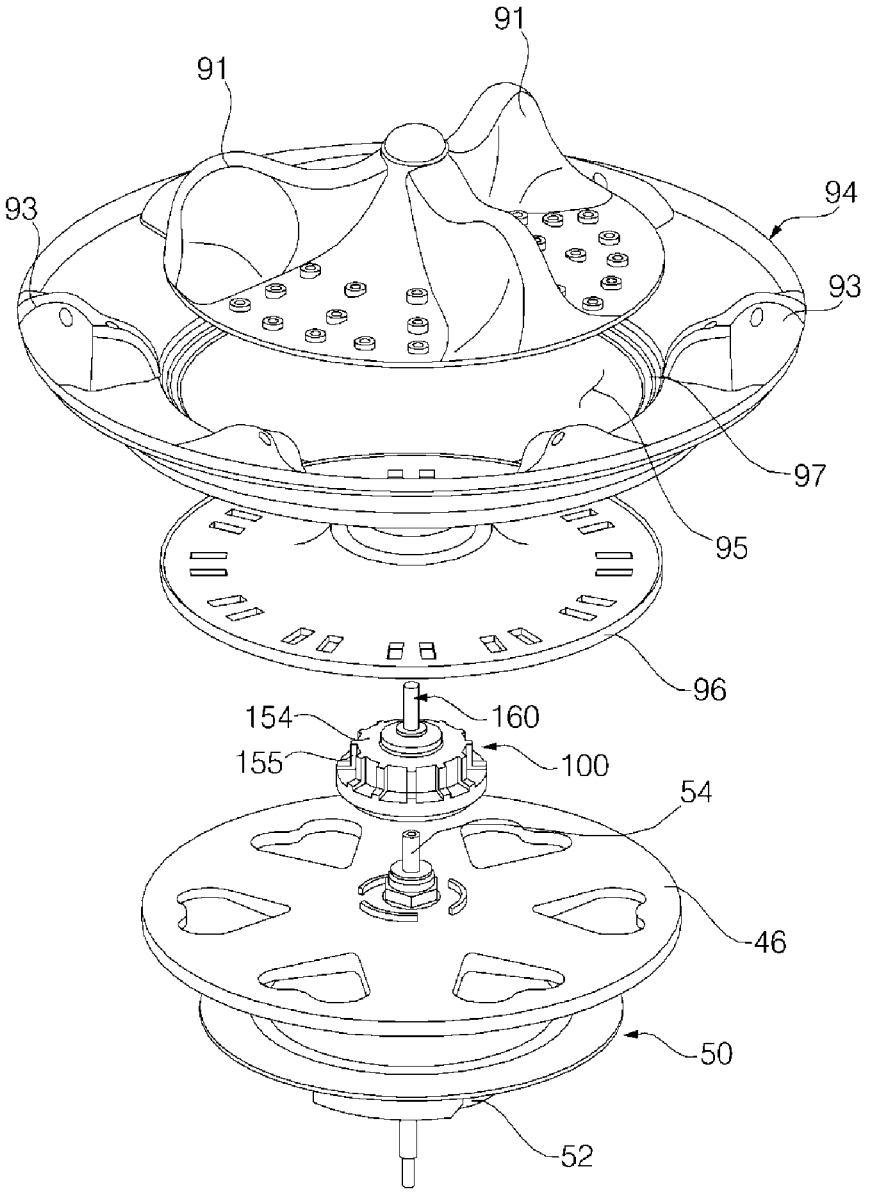
FIG. 3 is an exploded perspective view of the dual pulsator illustrated in FIG. 1.
Figure 4:
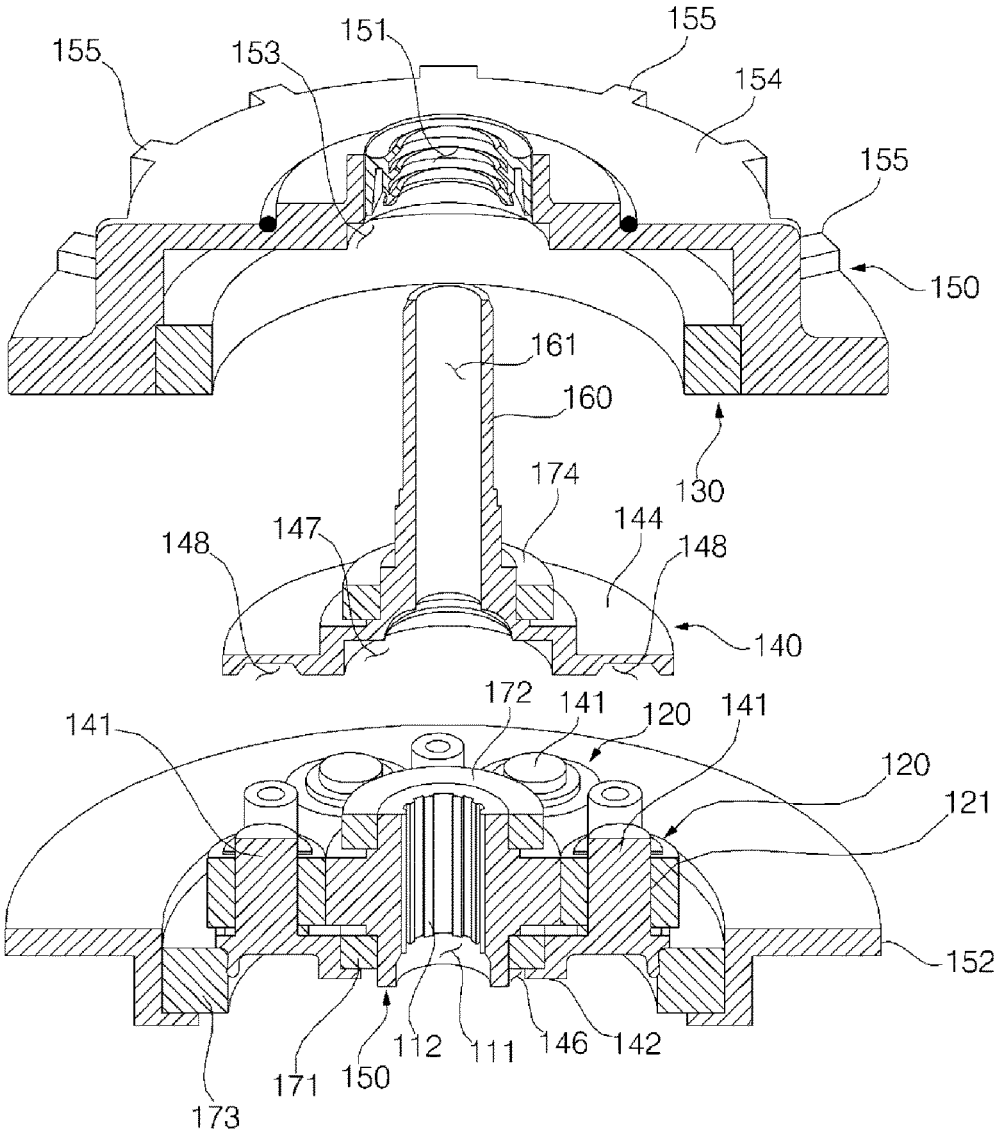
FIG. 4 is a sectional exploded perspective view of a gearbox illustrated in FIGS. 2A and 2B.
Figure 5:
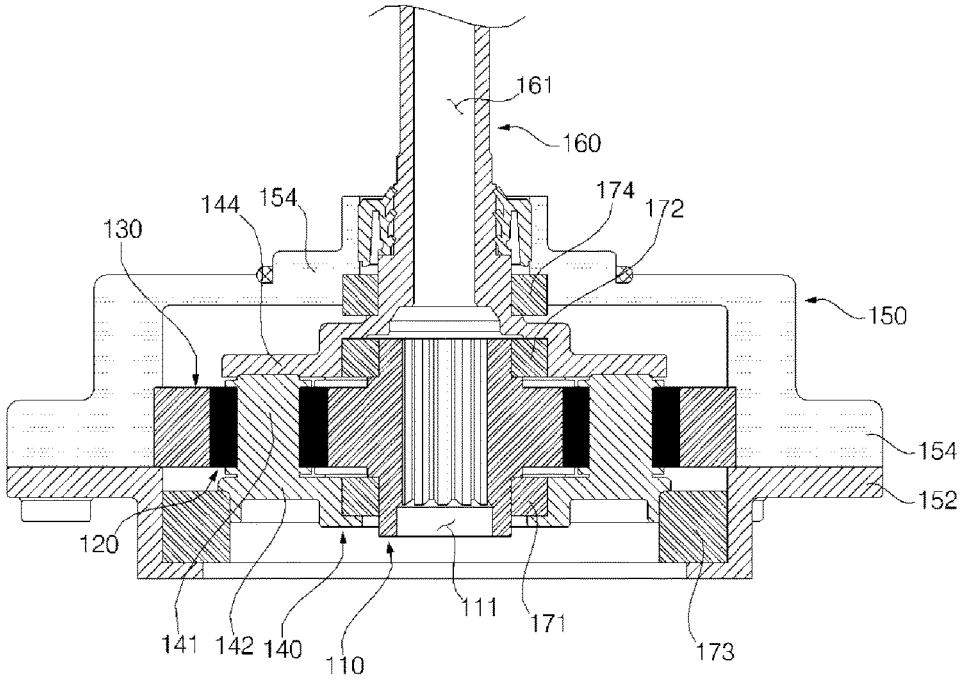
FIG. 5 is a sectional view of the gearbox illustrated in FIGS. 2A and 2B.
Figure 7A:
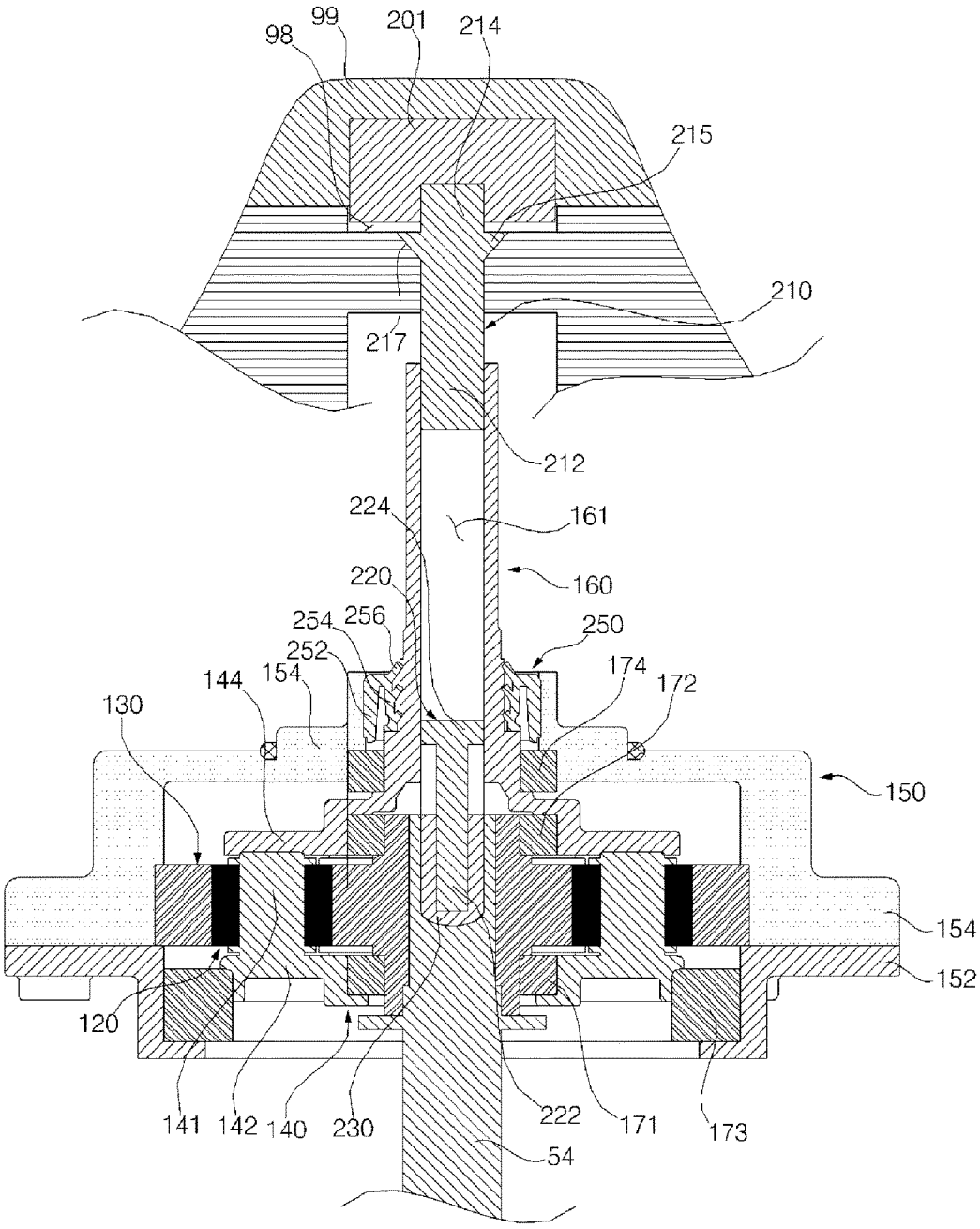
FIG. 7A is a sectional view illustrating a coupling structure of an inner pulsator and a drive shaft illustrated in FIG. 2A according to the first embodiment.
Figure 7B:
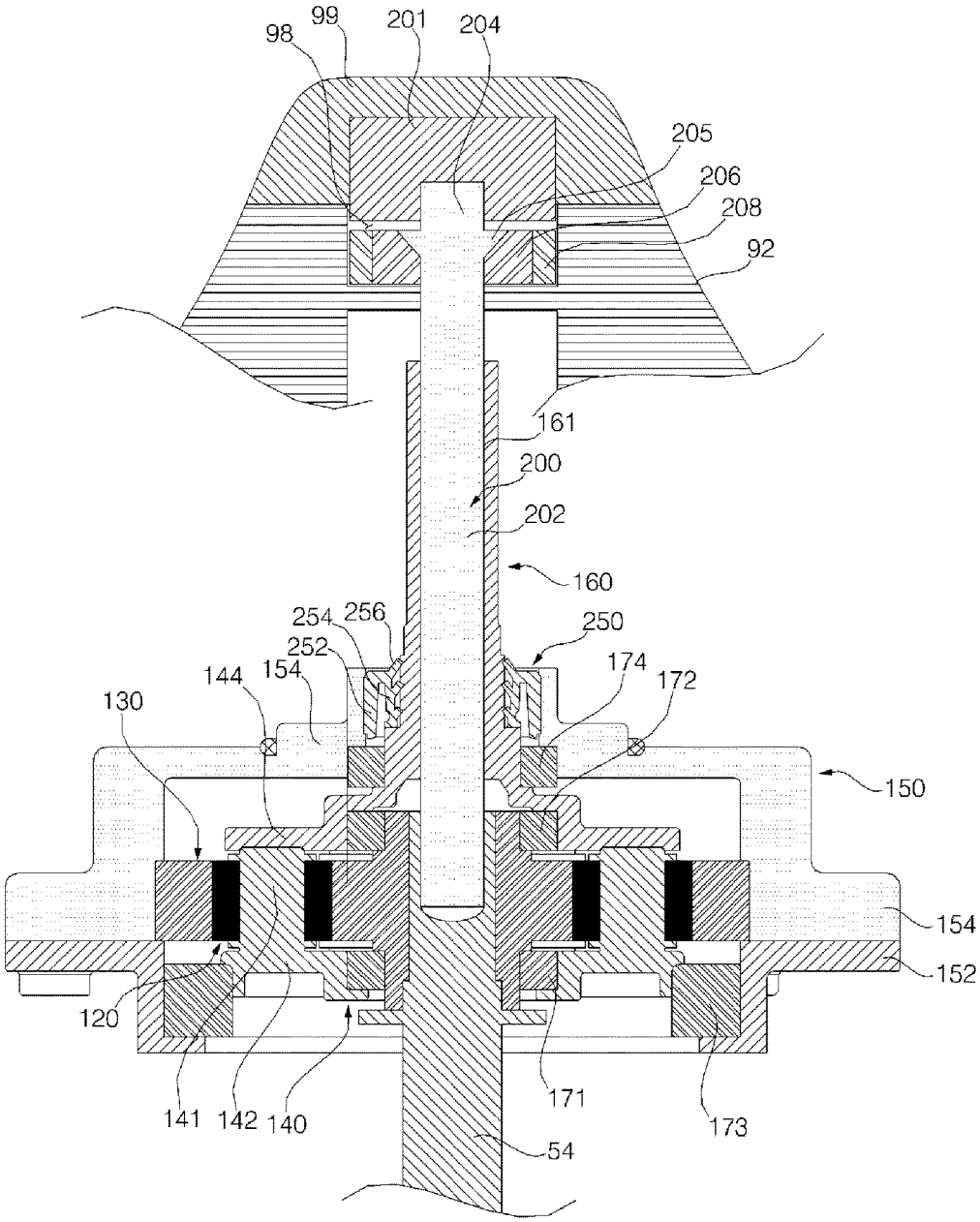
FIG. 7B is a sectional view illustrating a coupling structure of an inner pulsator and a drive shaft illustrated in FIG. 2B according to the second embodiment.

The coupling structure of inner pulsator 92 and drive shaft 54 according to the first embodiment will be described below with reference to FIGS. 2A and 7A. The top-loading-type washing machine according to the first embodiment further includes a top bolt 210 for connecting the inner pulsator 92 and carrier shaft 160 to each other. Long-axis bolt 220 according to the first embodiment has an upper end inserted into carrier shaft bore 161.

In the first embodiment, torque of carrier 140 is transferred to inner pulsator 92.

Carrier shaft 160 is placed on carrier 140 and inner pulsator 92 and drive shaft 54 are assembled with each other via carrier shaft 160.

In the first embodiment, top bolt 210 for assembling inner pulsator 92 and carrier shaft 160 with each other and long-axis bolt 220 for assembling carrier shaft 160 and drive shaft 54 with each other are installed.

Top bolt 210 is installed at the rotation center of inner pulsator 92. Inner pulsator 92 has a bolt installation recess 98 in which top bolt 210 is installed. Top bolt 210 does not transfer torque to inner pulsator 92.

Top bolt 210 serves to couple inner pulsator 92 to carrier shaft 160.

Top bolt 210 includes a bolt body 212 and a bolt head 214 formed on the upper end of bolt body 212.

Bolt body 212 penetrates inner pulsator 92 and is inserted into carrier shaft bore 161. The lower end of bolt body 212 is fastened to carrier shaft 160.

Bolt body 212 and carrier shaft 161 have screw-threads for fastening therebetween.

The screw-threads may be formed on only a portion of bolt body 212.

The lower end of bolt body 212 is fastened to carrier shaft 160. To this end, male screw-thread are formed on only a portion of the lower end of bolt body 212. Female screw-threads are formed on the upper end of carrier shaft bore 161.

The lower end of top bolt 210 may be fastened and coupled to the upper end of carrier shaft bore 161, and the upper end of top bolt 210 may be rotated relative to inner pulsator 92.

Top bolt 210 may have a tapered bolt portion 215, which protrudes radially from bolt head 214. Tapered bolt portion 215 is tapered downward.

A bolt support portion 217, which corresponds to tapered bolt portion 215, is located in bolt installation recess 98. Tapered bolt portion 215 and bolt support portion 217 may have a hopper shape.

Bolt body 212 penetrates bolt support portion 217.

Top bolt 210 is fastened to carrier shaft 160, thereby limiting the upward movement of inner pulsator 92.

Top bolt 210 is directly connected to carrier shaft 160, and therefore is rotated at the same speed as carrier shaft 160. Inner pulsator 92 is coupled to the outer circumference side of carrier shaft 160 so as to receive torque. As such, inner pulsator 92 is rotated at the same speed as carrier shaft 160.

That is, although inner pulsator 92 may be rotated relative to top bolt 210 via the fastening structure of top bolt 210, the relative rotation may not be realized because carrier shaft 160 and inner pulsator 92 are coupled to each other.

Inner pulsator 92 and carrier shaft 160 substantially operate integrally with each other.

However, inner pulsator 92 may perform relative rotation by a predetermined angle around bolt head 214 due to elasticity or deformation of the material of inner pulsator 92.

Meanwhile, the top-loading-type washing machine may further include an inner cap 99, which covers bolt installation recess 98 and prevents the introduction of wash water. Inner cap 99 covers the top of bolt installation recess 98. Inner cap 99 is assembled with inner pulsator 92. Inner cap 99 is rotated along with inner pulsator 92. A sealing member 201 for preventing the introduction of wash water may further be installed inside inner cap 99.

Top bolt 210 penetrates inner pulsator 92 and is fastened to carrier shaft 160. Top bolt 210 is supported at the upper end thereof by inner pulsator 92 and the lower end of top bolt 210 is inserted into and fastened to carrier shaft bore 161. Top bolt 210 includes bolt head 214 supported by inner pulsator 92. Top bolt 210 includes bolt body 212, which is inserted into carrier shaft bore 161 and is fastened to carrier shaft 160.

Long-axis bolt 220 may be installed on carrier shaft 160.

Long-axis bolt 220 is located in carrier shaft bore 161. Long-axis bolt 220 is assembled with drive shaft 54.

Long-axis bolt 220 includes a bolt head 224 and a bolt body 222.

Bolt body 222 is provided with male screw-threads. Bolt body 222 is screwed to drive shaft 54. For screwing, the upper end of drive shaft 54 is provided with female screw-threads.

Bolt head 224 is inserted in carrier shaft bore 161. Bolt head 224 is not constrained by carrier shaft bore 161 or carrier shaft 160. Bolt head 224 is vertically movable along carrier shaft bore 161. Bolt head 224 is rotatable in carrier shaft bore 161.

That is, bolt head 224 may be rotated relative to carrier shaft 160.

In the first embodiment, an adaptor 230 is installed between bolt body 222 and drive shaft 54. Adaptor 230 serves to compensate for a diameter difference. Unlike the first embodiment, when the male screw-threads of bolt body 222 and the female screw-threads of drive shaft 54 have the same diameter, bolt body 222 and drive shaft 54 may be directly fastened to each other.

The upper end of long-axis bolt 220 is inserted into carrier shaft bore 161. Long-axis bolt 220 includes bolt head 224, which is inserted into carrier shaft bore 161 and is movable along carrier shaft bore 161. Long-axis bolt 220 includes bolt body 222 fastened to drive shaft 54.

When drive shaft 54 is rotated, long-axis bolt 220 is rotated integrally with drive shaft 54 and is rotated relative to carrier shaft 160 differently from carrier shaft 160. Long-axis bolt 220 is connected to drive shaft 54 so as to rotate at the same speed and direction as drive shaft 54. The coupling structure of inner pulsator 92 and drive shaft 54 according to the second embodiment will be described with reference to FIGS. 2B and 7B. Long-axis bolt 200 according to the second embodiment penetrates carrier shaft 160, has an upper end supported by inner pulsator 92, and is rotated relative to inner pulsator 92 and carrier shaft 160.

In the second embodiment, torque of carrier 140 is transferred to inner pulsator 92.

Carrier shaft 160 is placed on carrier 140, and inner pulsator 92 and drive shaft 54 are assembled with each other via carrier shaft 160.

In the second embodiment, long-axis bolt 200 for assembling inner pulsator 92 and drive shaft 54 with each other is used.

Long-axis bolt 200 is installed at the rotation center of inner pulsator 92. Inner pulsator 92 has bolt installation recess 98 in which long-axis bolt 200 is installed. Long-axis bolt 200 does not transfer torque to inner pulsator 92.

Long-axis bolt 200 serves to fasten inner pulsator 92 to drive shaft 54. Torque is transferred to inner pulsator 92 via carrier shaft 160.

Long-axis bolt 200 includes a bolt body 202 and a bolt head 204 formed on the upper end of bolt body 202.

Bolt body 202 penetrates inner pulsator 92 and is inserted into carrier shaft bore 161. The lower end of bolt body 202 is fastened to drive shaft 54.

Bolt body 202 and drive shaft 54 are provided with screw-threads for fastening therebetween.

The screw-threads may be formed on only a portion of bolt body 202. That is, bolt body 202 is not fastened to carrier shaft 160, but fastened to drive shaft 54.

To this end, male screw-threads may be formed on only a portion of bolt body 202. The upper end of drive shaft 54 is provided with female screw-threads so that the lower end of bolt body 202 is inserted into and fastened to the upper end of drive shaft 54.

As such, bolt body 202 and carrier shaft 160 may be rotated relative to each other.

Long-axis bolt 200 may have a tapered bolt portion 205, which protrudes radially from bolt head 204. Tapered bolt portion 205 is tapered downward.

A bolt support portion 206 is located in bolt installation recess 98 in order to support tapered bolt portion 205. Long-axis bolt 200 is installed to penetrate bolt support portion 206. The inner surface of bolt support portion 206 has a slope corresponding to tapered bolt portion 205.

Bolt support portion 206 supports the bottom of bolt head 214.

Tapered bolt portion 205 limits the upward movement of inner pulsator 92.

A bolt bearing 208 may further be installed between bolt support portion 206 and inner pulsator 92. Bolt bearing 208 reduces friction with long-axis bolt 200 when inner pulsator 92 is rotated.

When no bolt support portion 206 is installed, bolt bearing 208 may be installed between bolt head 204 and inner pulsator 92. Tapered bolt portion 205 may be omitted.

Long-axis bolt 200 is directly connected to drive shaft 54, and therefore is rotated at the same speed as drive shaft 54. Inner pulsator 92 is coupled to carrier shaft 160, and therefore is rotated at the same speed as carrier 140.

Because the rotation speed of carrier 140 and the rotation speed of drive shaft 54 may be different, bolt bearing 208 may be installed to reduce friction.

The top-loading-type washing machine may further include inner cap 99, which covers bolt installation recess 98 and prevents the introduction of wash water. Inner cap 99 covers the top of bolt installation recess 98. Inner cap 99 is assembled with inner pulsator 92. Inner cap 99 is rotated along with inner pulsator 92. Sealing member 201 for preventing the introduction of wash water may be additionally installed inside inner cap 99.

The upper end of long-axis bolt 200 penetrates inner pulsator 92, and long-axis bolt 200 limits the upward movement of inner pulsator 92. Bolt head 204 is supported by inner pulsator 92. Bolt body 202 is fastened to drive shaft 54. Bolt support portion 206 is located between inner pulsator 92 and bolt head 204 and supports bolt head 204. Bolt head 204 has tapered bolt portion 205 protruding radially therefrom. Tapered bolt portion 205 is supported by bolt support portion 206. Bolt bearing 208 is located between bolt support portion 206 and inner pulsator 92. Inner pulsator 92 has bolt installation recess 98 in which long-axis bolt 200 is installed. The top-loading-type washing machine includes inner cap 99, which covers bolt installation recess 98 and is coupled to inner pulsator 92.

When drive shaft 54 is rotated, long-axis bolt 220 is rotated integrally with drive shaft 54 and is rotated relative to carrier shaft 160 and inner pulsator 92 differently from carrier shaft 160 and inner pulsator 92. long-axis bolt 220 is connected to drive shaft 54 so as to rotate at the same speed and direction as drive shaft 54.

Figure 8:
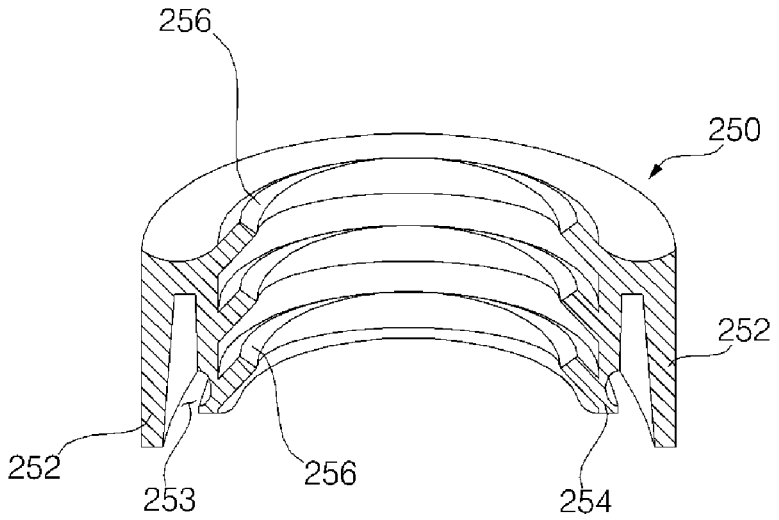
FIG. 8 is a partially cut-away perspective view of a sealing member illustrated in FIGS. 7A and 7B.

The sealing of the carrier shaft according to the present embodiment (i.e. the first embodiment or the second embodiment) will be described with reference to FIG. 8.

A sealing member 250 for preventing the introduction of wash water may further be installed between carrier shaft 160 and gear housing 150, which are rotated.

Sealing member 250 is installed in carrier shaft hole 151. Sealing member 250 surrounds carrier shaft 160, which penetrates carrier shaft hole 151.

Sealing member 250 is located above fourth bearing 174.

The entire sealing member 250 has a ring shape.

Sealing member 250 includes a sealing body 252, which comes into close contact with gear housing 150 and is supported by gear housing 150, and a tensional sealing portion 254, which is connected to sealing body 252 and comes into close contact with carrier shaft 160.

Sealing body 252 is located at an outer position, and tensional sealing portion 254 is located at an inner position.

Tensional sealing portion 254 may be elastically deformed relative to sealing body 252. Tensional sealing portion 254 is bent downward from the upper end of sealing body 252.

A tensional space 253 is defined between tensional sealing portion 254 and sealing body 252.

A sealing arm 256 may protrude from tensional sealing portion 254 toward carrier shaft 160 and may be oriented to face upward. A plurality of sealing arms 256 may be arranged in the vertical direction. Sealing arms 256 have a ring shape.

As is apparent from the above description, a top-loading-type washing machine according to the present invention has an advantage of achieving excellent washing performance because an inner pulsator and an outer pulsator are rotated in opposite directions.

The top-loading-type washing machine according to the present invention has an advantage in that the rotation speeds of the inner pulsator and the outer pulsator are variable depending on the size of the laundry load.

The top-loading-type washing machine according to the present invention has an advantage of reducing power consumption because the rotation speeds of the inner pulsator and the outer pulsator are variable depending on the size of the laundry load.

The top-loading-type washing machine according to the present invention has an advantage of reducing damage to laundry because the rotation speeds of the inner pulsator and the outer pulsator are reduced under the condition of a high load.

The top-loading-type washing machine according to the present invention has an advantage of minimizing friction and interference due to relative rotation when the inner pulsator is rotated because a top bolt is used to rotate along with the inner pulsator and a long-axis bolt is used to rotate along with a drive shaft.

The top-loading-type washing machine according to the present invention has an advantage in that a carrier and the drive shaft, which are rotated at different speeds, are assembled with each other using only a top bolt and a long-axis bolt.

What is claimed is:

1. A top-loading-type washing machine comprising:

a drum;

a drive module for rotating the drum via a drive shaft;

an inner pulsator located on the drive shaft, the inner pulsator being rotated by torque from the drive module;

an outer pulsator located below the inner pulsator, the outer pulsator being rotated by torque from the drive module; and a gearbox connected to the drive shaft to receive torque from the drive module, the gearbox rotating the inner pulsator and the outer pulsator in opposite directions, wherein the gearbox includes:

a sun gear connected to and rotating with the drive shaft;

a plurality of planetary gears engaged with the sun gear, each of the planetary gears rotating on its own rotation axis while traveling along an outer circumferential surface of the sun gear;

a ring gear engaged with the planetary gears so as to perform rotation;

a carrier including a planetary gear shaft for providing the rotation axis of each planetary gear and for connecting the planetary gears to one another, the carrier being rotated when the planetary gear shaft revolves around the sun gear by rotation of the planetary gears;

a gear housing to which the ring gear is fixed, the gear housing being coupled to the outer pulsator for transferring torque; and a carrier shaft formed on the carrier and coupled to the inner pulsator for transferring torque, wherein the carrier shaft has a carrier shaft bore formed therein so as to communicate with an inside of the gearbox, and wherein the top-loading-type washing machine further comprises a long-axis bolt having a lower end fastened to the drive shaft, the long-axis bolt being inserted into the carrier shaft bore and being rotated in the carrier shaft bore.

2. The top-loading-type washing machine of claim 1, further comprising:

a top bolt for connecting the inner pulsator and the carrier shaft to each other.

3. The top-loading-type washing machine of claim 2, wherein the top bolt penetrates the inner pulsator and is fastened to the carrier shaft.

4. The top-loading-type washing machine of claim 2, wherein the top bolt has an upper end supported by the inner pulsator and a lower end inserted into and fastened to the carrier shaft bore.

5. The top-loading-type washing machine of claim 4, wherein the top bolt includes:

a bolt head supported by the inner pulsator; and a bolt body inserted into the carrier shaft bore and fastened to the carrier shaft.

6. The top-loading-type washing machine of claim 2, wherein the inner pulsator has a bolt installation recess for installation of the top bolt, and wherein the top-loading-type washing machine further comprises an inner cap for covering the bolt installation recess and preventing introduction of wash water.

7. The top-loading-type washing machine of claim 1, wherein the long-axis bolt has an upper end inserted into the carrier shaft bore.

8. The top-loading-type washing machine of claim 7, wherein the long-axis bolt includes:

a bolt head inserted into the carrier shaft bore and installed so as to be movable along the carrier shaft bore; and a bolt body fastened to the drive shaft.

9. The top-loading-type washing machine of claim 1, wherein the long-axis bolt penetrates the carrier shaft, has an upper end supported by the inner pulsator, and is rotated relative to the inner pulsator and the carrier shaft.

10. The top-loading-type washing machine of claim 9, wherein the upper end of the long-axis bolt penetrates the inner pulsator, and the long-axis bolt limits upward movement of the inner pulsator.

11. The top-loading-type washing machine of claim 9, wherein the long-axis body includes:

a bolt body; and a bolt head formed on an upper end of the bolt body, and wherein the bolt head is supported by the inner pulsator, and the bolt body is fastened to the drive shaft.

12. The top-loading-type washing machine of claim 11, further comprising:

a bolt support portion located between the inner pulsator and the bolt head for supporting the bolt head.

13. The top-loading-type washing machine of claim 12, wherein the bolt head has a tapered bolt portion protruding radially therefrom, and the tapered bolt portion is supported by the bolt support portion.

14. The top-loading-type washing machine of claim 13, further comprising:

a bolt bearing located between the bolt support portion and the inner pulsator.

15. The top-loading-type washing machine of claim 9, wherein the inner pulsator has a bolt installation recess for installation of the long-axis bolt, and wherein the top-loading-type washing machine further comprises an inner cap for covering the bolt installation recess, the inner cap being coupled to the inner pulsator.

16. The top-loading-type washing machine of claim 1, wherein the lower end of the long-axis bolt is inserted into the gearbox and is fastened to the drive shaft located inside the gearbox.

17. The top-loading-type washing machine of claim 1, wherein the long-axis bolt is rotated along with the drive shaft.

18. The top-loading-type washing machine of claim 1, wherein the sun gear has a sun gear bore formed therein, and the drive shaft is inserted into and coupled to the sun gear bore.

19. The top-loading-type washing machine of claim 1, wherein the carrier includes:

an upper carrier body placed above the sun gear and the planetary gears;

a lower carrier body placed below the sun gear and the planetary gears; and a planetary gear shaft formed on at least one of the upper carrier body and the lower carrier body for providing a rotation axis of each planetary gear, wherein the carrier shaft is formed on the upper carrier body.

20. The top-loading-type washing machine of claim 1, wherein the gear housing includes:

a lower housing placed below the sun gear, the planetary gears, and the carrier; and an upper housing placed above the lower housing and coupled to the outer pulsator, wherein the ring gear is fixed to one of the upper housing and the lower housing, and the carrier shaft is located to penetrate the upper housing.

* * * * *